US012807889B2

(12) United States Patent
Almulla et al.

(10) Patent No.: US 12,807,889 B2
(45) Date of Patent: Nov. 24, 2026

(54) METHODS FOR PRODUCING LIQUID ORGANIC HYDROGEN CARRIERS FROM PLASTIC OIL

(71) Applicant: Saudi Arabian Oil Company, Dhahran (SA)

(72) Inventors: Faisal M. Almulla, Dhahran (SA); Anas S. Al-Aqeeli, Dhahran (SA); Guanghui Zhu, Dhahran (SA); Raed H. Abudawoud, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 322 days.

(21) Appl. No.: 18/538,229

(22) Filed: Dec. 13, 2023

(65) Prior Publication Data

US 2025/0197738 A1 Jun. 19, 2025

(51) Int. Cl.

| | |
|---|---|
| ***C10G 49/04*** | (2006.01) |
| ***C10G 49/22*** | (2006.01) |
| ***C10G 69/02*** | (2006.01) |

(52) U.S. Cl.

CPC ..... *C10G 49/22* (2013.01); *C10G 49/04* (2013.01); *C10G 2300/4062* (2013.01); *C10G 2400/30* (2013.01)

(58) Field of Classification Search

CPC ..... C10G 49/04; C10G 49/22; C10G 69/02; C10G 2300/4065

See application file for complete search history.

(56) References Cited

U.S. PATENT DOCUMENTS

| | | | | |
|---|---|---|---|---|
| 4,515,659 | A * | 5/1985 | Wingfield, Jr. | C10B 53/07 201/2.5 |
| 2022/0109175 | A1* | 4/2022 | Allinson | C01B 3/0015 |
| 2022/0298436 | A1 | 9/2022 | Allinson et al. | |
| 2023/0013013 | A1 | 1/2023 | Koseoglu et al. | |
| 2023/0272293 | A1 | 8/2023 | Weiss et al. | |
| 2023/0287283 | A1* | 9/2023 | Weiss | C10G 1/002 |
| 2023/0323221 | A1 | 10/2023 | Kim et al. | |

FOREIGN PATENT DOCUMENTS

| | | | | |
|---|---|---|---|---|
| EP | 2960204 | A1 | 12/2015 | |
| WO | WO-2024030740 | A1 * | 2/2024 | C10G 1/10 |

OTHER PUBLICATIONS

A. Bourane et al., An Overview of Organic Liquid Phase Hydrogen Carriers, 41 Int. J. Hydrog. Energy 23075-23091 (2016).*

H. Jorschick et al., Hydrogenation of Aromatic and Heteroaromatic Compounds—A Key Process for Future Logistics of Green Hydrogen Using Liquid Organic Hydrogen Carrier Systems, 5 Sustainable Energy Fuels 1311-1346 (2021).*

P. C. Rao et al., Methylbenzene Naphthalene: Liquid Organic Hydrogen Carrier for Facile Hydrogen Storage and Release, 11 ACS Sustainable Chem. Eng. 12656-12666 (2023).*

Abdin, et al., "Large-scale stationary hydrogen storage via liquid organic hydrogen carriers", iScience, vol. 24, No. 102966, Sep. 24, 2021.

Notification of Transmittal of the International Search Report and the Written Opinion of the International Searching Authority, or the Declaration dated Feb. 21, 2025 pertaining to International application No. PCT/US2024/059287 filed Dec. 10, 2024, pp. 1-11.

* cited by examiner

*Primary Examiner* — Randy Boyer

(74) *Attorney, Agent, or Firm* — Dinsmore & Shohl LLP

(57) ABSTRACT

A method for producing liquid organic hydrogen carriers from plastic oil. The method includes passing a plastic oil stream and an input hydrogen stream to a hydrogenation unit to form a hydrotreated effluent stream and passing the hydrotreated effluent stream to a separator to isolate the liquid organic hydrogen carriers as an LOHC stream from the unreacted hydrogen and byproducts as a residual stream. The method further includes passing the residual stream to a reclamation unit to recover the unreacted hydrogen as a recovered hydrogen stream from the residual stream and passing the recovered hydrogen stream to the hydrogenation unit to offset hydrogen demand from the input hydrogen stream. The remainder of the residual stream upon recapture of the unreacted hydrogen generates a byproducts stream.

16 Claims, 4 Drawing Sheets

METHODS FOR PRODUCING LIQUID ORGANIC HYDROGEN CARRIERS FROM PLASTIC OIL

TECHNICAL FIELD

Embodiments of the present disclosure generally relate methods and systems utilized to transport hydrogen atoms while the hydrogen atoms are chemically bonded to hydrocarbons, and more specifically, to methods and systems for producing liquid organic hydrogen carriers from plastic oil for transporting hydrogen.

BACKGROUND

Production and consumption of plastics have surged in recent decades, leading to a dramatic increase in plastic waste generation. Millions of tons of plastic waste end up in landfills, oceans, and other natural environments, causing ecological harm and endangering marine life. Simultaneously, the world is grappling with the depletion of finite fossil fuel resources, leading to the search for alternative, sustainable energy sources. Converting plastic waste into oil through processes like pyrolysis and depolymerization offers a potential solution to both the plastic waste crisis and the need for alternative energy sources. These processes break down plastic polymers into smaller hydrocarbon molecules, which can be refined into usable oil products.

At the same time as increased generation of plastic waste, demand for hydrogen is growing in importance as an environmentally friendly precursor chemical and fuel. Processes for the production and usage of hydrogen are relatively well developed. However, processes for the storage and transportation of hydrogen are still insufficient to meet the needs of the hydrogen industry. Generally, hydrogen is stored and transported in the form of compressed gaseous hydrogen molecules (e.g., at above 5,000 pounds per square inch). However, these conventional gaseous hydrogen transportation techniques are costly and inefficient. For example, the compression process consumes a large amount of energy (estimated to be 30% or more of the energy content of the hydrogen). Also, transport and storage of the compressed hydrogen requires expensive pressure vessels. Some of the hydrogen molecules can even escape through the walls of hydrogen containment vessels. The hydrogen can also cause embrittlement of the storage and transport vessels. As such, hydrogen storage and transportation in liquid phase offers great advantages due to the ability to accommodate higher capacity than gaseous tubes.

Liquid Organic Hydrogen Carriers (LOHCs) are great example of enabling the hydrogen storage, due to the higher density, through hydrogenation and dehydrogenation cycles. The use of Liquid Organic Hydrogen Carriers (LOHCs) has several advantages. One advantage is that LOHCs can store hydrogen in high density, which makes it easier to transport and use. This is because hydrogen is gaseous at ambient conditions, diffuses easily, and has a low energy density. Another advantage is that LOHCs are expected to be used in a wide variety of applications because of their excellent long-term storage properties and stability at room temperature. Several examples of LOHC compounds were identified as promising and economically efficient candidates such as methanol, toluene, monobenzyl toluene, and dibenzyl toluene.

BRIEF SUMMARY

Embodiments of the present disclosure address both the increasing demand for hydrogen and the increasing proliferation of waste plastics. Liquid Organic Hydrogen Carriers (LOHCs) enable improved hydrogen storage through hydrogenation and dehydrogenation cycles. The use of Liquid Organic Hydrogen Carriers (LOHCs) has several advantages. One advantage is that LOHCs can store hydrogen in high density, which makes it easier to transport and use. This is because hydrogen is gaseous at ambient conditions, it diffuses easily and has a low energy density making transport of substantial quantities challenging. Another advantage is that LOHCs are expected to be used in a wide variety of applications because of their excellent long-term storage properties and stability at room temperature. Several examples of LOHC compounds have been identified as promising and economically efficient candidates for transport of hydrogen such as methanol, toluene, monobenzyl toluene, and dibenzyl toluene. Embodiments of the present disclosure provide methods for producing liquid organic hydrogen carriers from plastic oil. Accordingly the proliferation of waste plastics is utilized in an advantageous manner to generate LOHCs for transport and/or storage of hydrogen.

In accordance with one or more embodiments of the present disclosure, methods for producing liquid organic hydrogen carriers from plastic oil is provided. The methods includes passing a plastic oil stream and an input hydrogen stream to a hydrogenation unit to form a hydrotreated effluent stream, wherein the plastic oil stream comprises the liquid fraction from pyrolysis of waste plastics and the hydrotreated effluent stream comprises saturated liquid organic hydrogen carriers, unreacted hydrogen, and byproducts; passing the hydrotreated effluent stream to a separator to isolate the liquid organic hydrogen carriers as an LOHC stream from the unreacted hydrogen and byproducts as a residual stream; passing the residual stream to a reclamation unit to recover the unreacted hydrogen as a recovered hydrogen stream from the residual stream to generate a byproducts stream, wherein the byproducts stream comprise a remainder of the residual stream upon recapture of the unreacted hydrogen; and passing the recovered hydrogen stream to the hydrogenation unit to offset hydrogen demand from the input hydrogen stream.

In accordance with one or more further embodiments of the present disclosure, methods for producing liquid organic hydrogen carriers from plastic oil is provided. The methods comprise passing a plastic oil stream to a pre-treatment unit to generate a pretreated plastic oil stream; passing the pretreated plastic oil stream and an input hydrogen stream to a hydrogenation unit to form a hydrotreated effluent stream, wherein the plastic oil stream comprises the liquid fraction from pyrolysis of waste plastics and the hydrotreated effluent stream comprises saturated liquid organic hydrogen carriers, unreacted hydrogen, and byproducts; passing the hydrotreated effluent stream to a separator to isolate the liquid organic hydrogen carriers as an LOHC stream from the unreacted hydrogen and byproducts as a residual stream; passing the residual stream to a reclamation unit to recover the unreacted hydrogen as a recovered hydrogen stream from the residual stream to generate a byproducts stream, wherein the byproducts stream comprise a remainder of the residual stream upon recapture of the unreacted hydrogen; passing the recovered hydrogen stream to the hydrogenation unit to offset hydrogen demand from the input hydrogen stream; transporting the LOHC stream from a first hydrocarbon processing facility to a second hydrocarbon processing facility; and passing the LOHC stream to a dehydrogenation unit to form a dehydrogenated hydrocarbon stream and a hydrogen product stream, wherein the first hydrocarbon processing facility houses at least the hydrogenation unit, the separator, and the reclamation unit, the second hydrocarbon processing facility houses at least the dehydrogenation unit, and the first hydrocarbon processing facility and the second hydrocarbon processing facility are separated by at least 100 km.

These and other embodiments are described in more detail in the Detailed Description. It is to be understood that both the foregoing general description and the following detailed description present embodiments of the presently disclosed technology, and are intended to provide an overview or framework for understanding the nature and character of the technology as it is claimed. The accompanying drawings are included to provide a further understanding of the presently disclosed technology and are incorporated into and constitute a part of this specification. The drawings illustrate various embodiments and, together with the description, serve to explain the principles and operations of the presently disclosed technology. Additionally, the drawings and descriptions are meant to be merely illustrative, and are not intended to limit the scope of the claims in any manner.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

Figure 1:
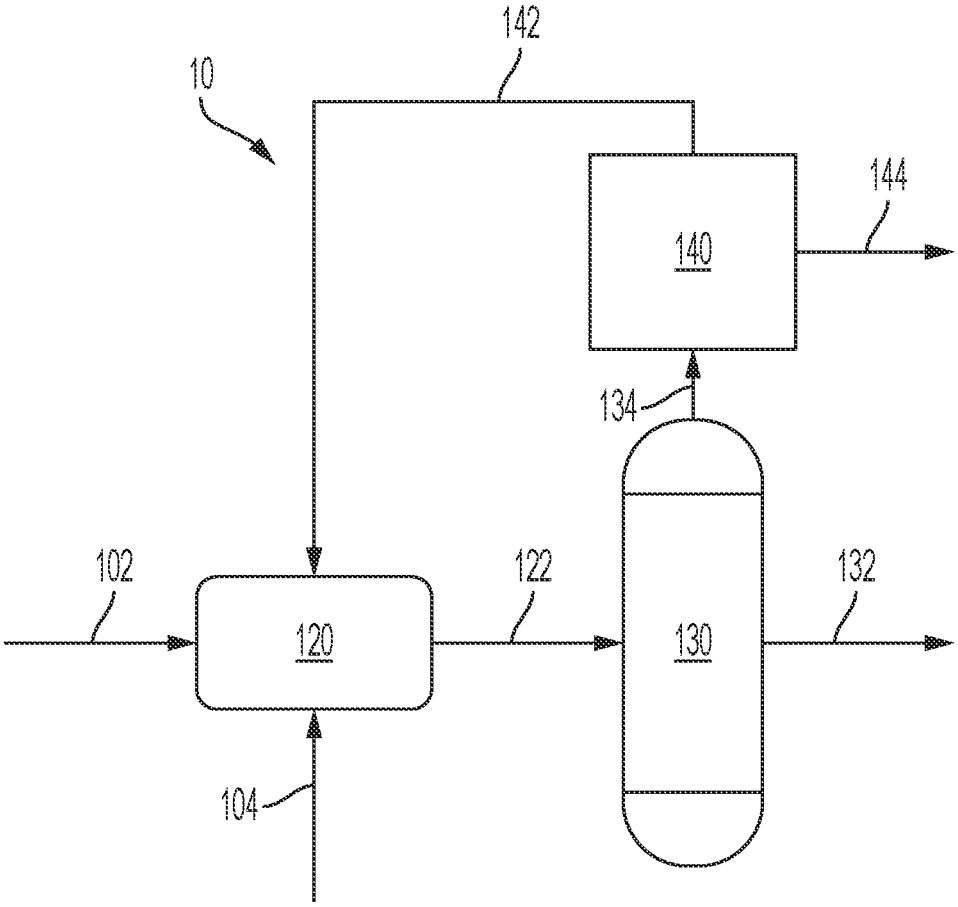
FIG. 1 schematically depicts a diagram of a system for producing liquid organic hydrogen carriers from plastic oil, according to one or more embodiments described in this disclosure.

It should further be noted that arrows in the drawings refer to process streams. However, the arrows may equivalently refer to transfer lines which may serve to transfer process streams between two or more system components. Additionally, arrows that connect multiple system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component. It should be understood that arrows in the relevant figures are not indicative of necessary or essential steps.

It should be understood that according to the embodiments presented in the relevant figures, an arrow between two system components may signify that the stream is not further processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Figure 2:
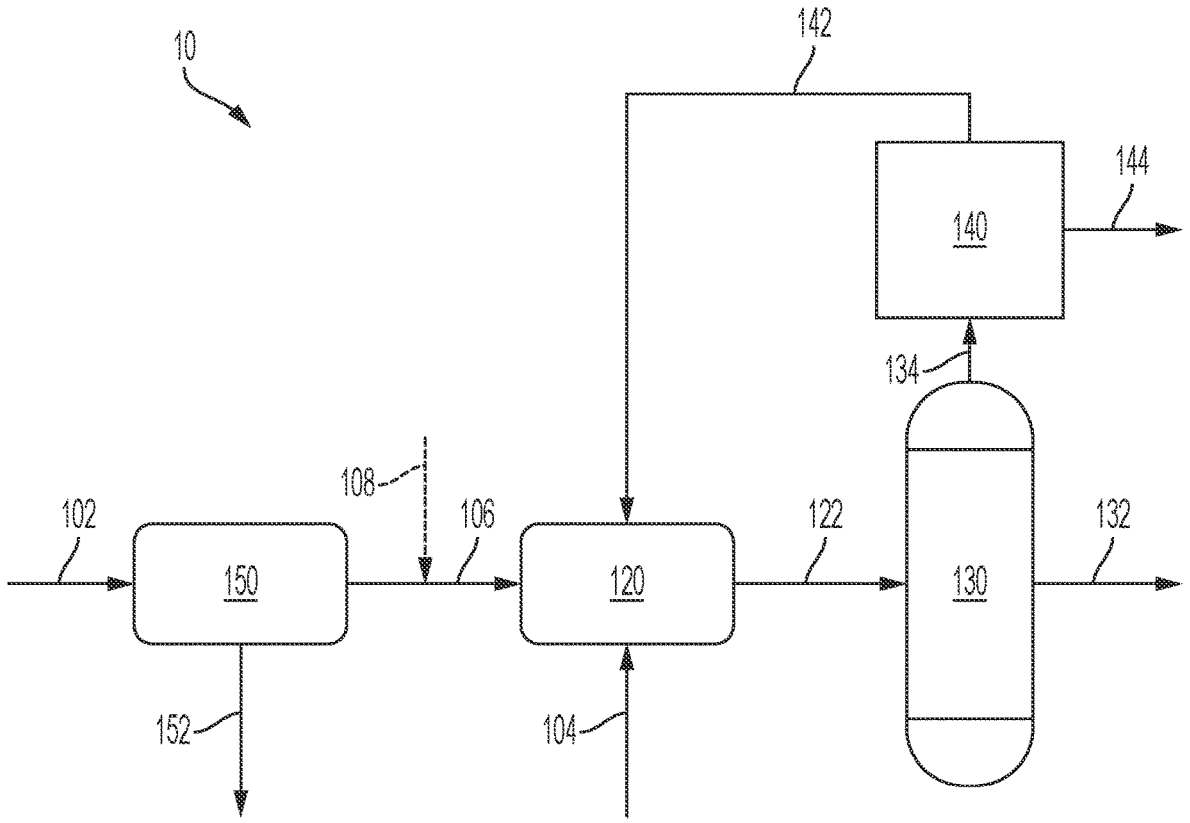
FIG. 2 schematically depicts a diagram of a system for producing liquid organic hydrogen carriers from plastic oil, according to one or more embodiments described in this disclosure.
Figure 3:
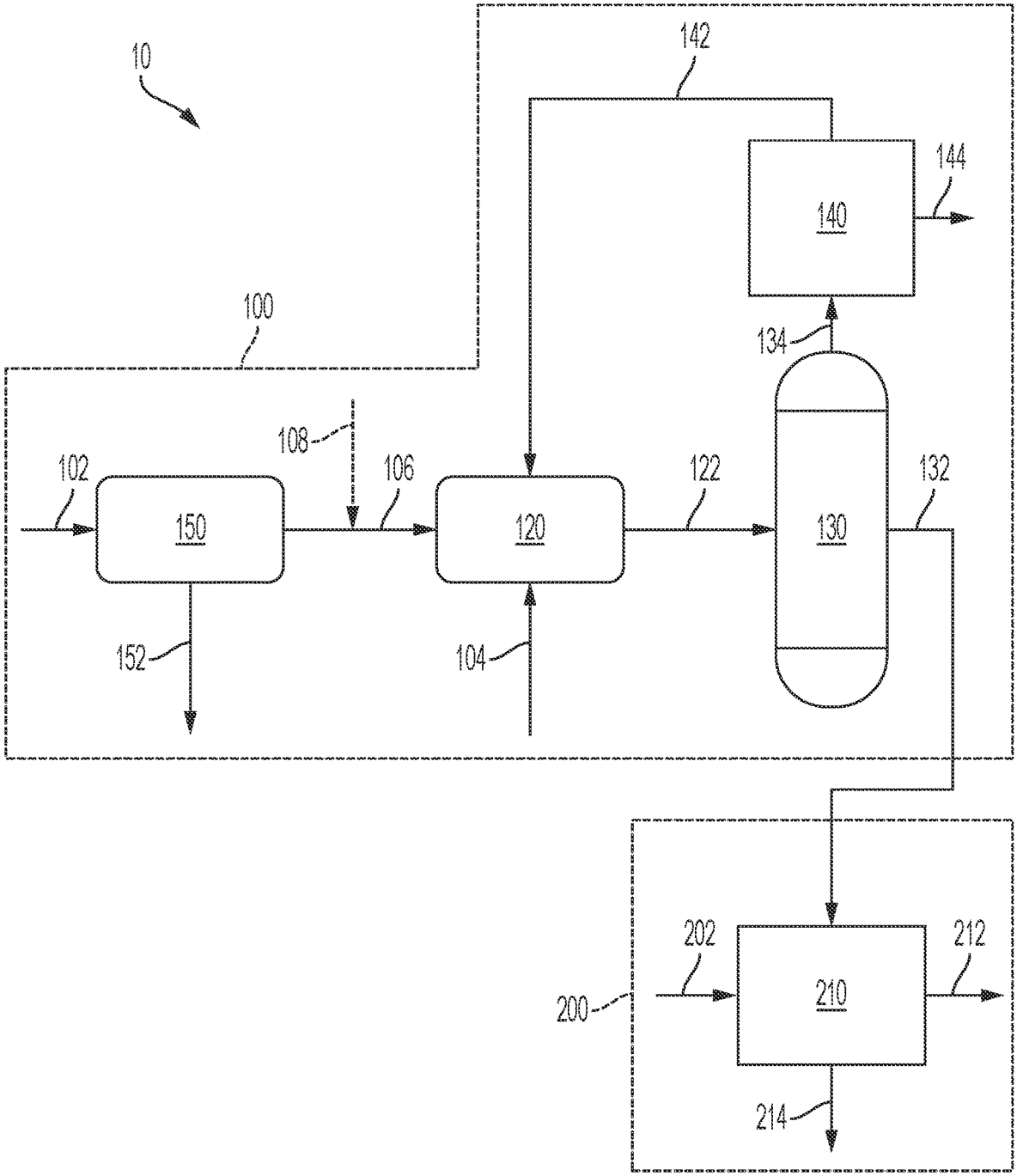
FIG. 3 schematically depicts a diagram of a system for producing liquid organic hydrogen carriers from plastic oil, according to one or more embodiments described in this disclosure.

Embodiments of the present disclosure relate to methods for producing liquid organic hydrogen carriers (LOHCs) from plastic oil. In general, these methods are described herein in the context of one or more systems, shown in the drawings. As is discussed herein, the systems for producing LOHCs from plastic oil utilize methods including hydrotreating a plastic oil stream to form a hydrotreated effluent stream; passing the hydrotreated effluent stream to a separator to isolate the liquid organic hydrogen carriers as an LOHC stream from the unreacted hydrogen and byproducts as a residual stream; the residual stream to a reclamation unit to recover the unreacted hydrogen as a recovered hydrogen stream from the residual stream to generate a byproducts stream; and passing the recovered hydrogen stream to the hydrogenation unit to offset hydrogen demand from other sources. Further embodiments of the methods for producing LOHCs from plastic oil include passing the plastic oil stream to a pre-treatment unit to generate a pretreated plastic oil stream and passing the pretreated plastic oil stream to the hydrogenation unit in lieu of the plastic oil stream. Yet further embodiments of the methods for producing LOHCs from plastic oil include transporting the LOHC stream from a first hydrocarbon processing facility to a second hydrocarbon processing facility and passing the LOHC stream to a dehydrogenation unit to form a dehydrogenated hydrocarbon stream and a hydrogen product stream. The embodiments of FIGS. 1-3 are similar or identical in many ways, respectively, but include differences as described herein. Description of the embodiments of FIGS. 1-3 may generally apply to the embodiments of the other figures, as would be understood by those skilled in the art. For example, concepts disclosed herein applicable to FIG. 2 or 3 may be equally applicable to FIG. 1, and vice versa, even if not explicitly stated as such herein.

As used in this disclosure, a "catalyst" refers to any substance which increases the rate of a specific chemical reaction. Catalysts described in this disclosure may be utilized to promote various reactions, such as, but not limited to, hydrotreating and dehydrogenation reactions. As used in this disclosure, a "hydrotreating catalyst" increases the rate of a hydrotreating reaction. As used in this disclosure, a "dehydrogenation catalyst" increases the rate of a dehydrogenation reaction. The methods described herein should not necessarily be limited by specific catalytic materials unless explicitly stated as such.

As used in this disclosure, a "separation unit" refers to any separation device or system of separation devices that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation.

As used in this disclosure, "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality. In general, "hydrocracking" refers to cracking in the presence of hydrogen.

As used in this disclosure, "hydrocarbons" refers to compounds consisting of hydrogen atoms and carbon atoms.

According to one or more embodiments, a plastic oil stream 102 and an input hydrogen stream 104 may be passed to the hydrogenation unit 120. The plastic oil stream 102 and the input hydrogen stream 104 may be combined before being passed to hydrogenation unit 120 or may be combined therein.

The plastic oil stream 102 represents the liquid products resulting from the pyrolysis of plastic waste. The particular composition of the plastic oil stream 102 may vary depending on the particular composition of the plastics utilized to generate the plastic oil stream 102. For example, pyrolysis oil generated from polystyrene is typically 95% aromatic hydrocarbons; pyrolysis oil generated from polypropylene, low density polyethylene, and high density polyethylene is typically dominated by aliphatic hydrocarbons; and pyrolysis oil generated from polystyrene typically comprises mainly aromatic hydrocarbons with some paraffins, naphthalene, and olefin compounds. In one or more embodiments, paraffins may range from 10 to 40 wt %, olefins from 10 to 30 wt %, and naphthalenes from 1 to 10 wt % in the plastic oil stream 102. It will be appreciated that such composition may be influenced by various factors including plastic composition and pyrolysis conditions. In one or more embodiments, the the plastic oil stream 102 may comprise aromatics within the range of 20 to 50 wt %. Further, the plastic oil stream 102 typically includes boiling ranges spanning from 100 to 600 °C with further embodiments encompassing narrower ranges therein. An example composition of the plastic oil stream 102 as supplied to the system 10 is provided in Tables 1A and 1B, but it will be appreciated that such composition is merely an example and plastic oil streams 102 with different compositions remain compatible with the presently disclosed method and system.

TABLE 1A

Example Plastic Pyrolysis Oil Composition

| Composition | Unit | Value |
|---|---|---|
| Density | $kg/m^3$ | 790 |
| Chlorine | ppmw | 130 |
| Nitrogen | ppmw | 1139 |
| Sulfur | ppmw | 82 |
| Oxygen | ppmw | 1562 |
| Metals | ppmw | 65 |
| Di-olefins | wt % | 19.6 |
| Mono-Olefins | wt % | 9.6 |

TABLE 1B

Example Plastic Pyrolysis Oil Composition
Boiling Range Breakdown

| Composition | Unit | Value |
|---|---|---|
| Naphtha (36-180° C.) | wt % | 30.6 |
| Diesel (180-370° C.) | wt % | 59.0 |
| VGO (370+° C.) | wt % | 10.4 |

The plastic oil stream 102, as supplied to the system 10, may include water, solids, and other contaminants as a natural result of the production process. In one or more embodiments, the plastic oil stream includes 0 to 5 weight percent (wt %) water. In various further embodiments, the plastic oil stream includes 0 to 4 wt %, 0 to 3 wt %, 0 to 2 wt %, 0 to 1 wt %, or 0.1 to 5 wt % water. It will be appreciated that water content within the plastic oil stream 102 above the disclosed ranges may be problematic during further processing. Specifically, excess water can lead to one or more of corrosion of equipment and infrastructure in plastic oil refining, deactivation or reduction in the efficiency of catalysts, induction of undesirable hydrolysis reactions reducing the quality of plastic oil, and reduction in the quality of oil-water separation impacting the downstream processing units. In one or more embodiments, the plastic oil stream includes 0 to 2 wt % of solids including particles of unprocessed plastics, solid contaminants, or residues from pyrolysis. In various further embodiments, the plastic oil stream includes 0 to 1 wt %, 0 to 0.8 wt %, 0 to 0.6 wt %, 0 to 0.5 wt %, or 0.1 to 1 wt % of solids. Other contaminants, such as chlorine, may also be present plastic oil stream 102 depending on the type of plastics utilized to form the plastic oil stream 102 as well as any treatments or coatings such waste plastics received during initial manufacturing. For example, is the waste plastics utilized to form the plastic oil stream 102 did not contain polyvinyl chloride (PVC) the chlorine content is typically below 0.1%, but if the plastic oil stream 102 was formed from a large percentage of PVC the chlorine levels in the plastic oil stream 102 may be up to 4 wt % and typically in the range of 2 to 4 wt %.

The input hydrogen stream 104 may comprise hydrogen gas. In one or more embodiments, the input hydrogen stream 104 may comprise at least 80 wt. %, at least 90 wt. %, at least 95 wt. %, at least 99 wt. %, or at least 99.9 wt. % of hydrogen gas, on the basis of the total weight of input hydrogen stream 104.

The hydrogenation unit 120 may hydrotreat the plastic oil stream 102. Hydrotreating refers to the process of contacting a hydrocarbon with a hydrotreating catalyst in the presence of hydrogen, thus hydrogenating the hydrocarbons. Generally, hydrotreating does not crack hydrocarbons. Rather, hydrotreating may saturate hydrocarbons without decreasing their chain length. Additionally, hydrotreating may also be used to remove contaminants from hydrocarbons, such as sulfur and metals.

In one or more embodiments, the hydrogenation unit 120 may utilize a hydrotreating catalyst. Any hydrotreating catalyst known to those skilled in the art may be utilized as selected based on the composition of the feed including the plastic oil stream 102 provided to the hydrogenation unit 120. In various embodiments, the hydrotreating catalyst may comprise cobalt, molybdenum, tungsten, nickel-tungsten, nickel-cobalt, or nickel-molybdenum, on an alumina, silica-alumina, or zeolite support.

In various embodiments, the hydrogenation unit 120 may be operated at a reaction temperature from 300 °C to 420 °C, such as from 300 °C to 410 °C, from 320 °C to 420 °C, from 330 °C to 420 °C, from 340 °C to 420 °C, from 350 °C to 420 °C, from 320 °C to 410° C., from 350 °C to 410 °C, or any subset thereof.

In various embodiments, the hydrogenation unit 120 may be operated at a pressure of from 50 bar to 150 bar, such as from 50 bar to 130 bar, from 50 bar to 115 bar, from 60 bar to 150 bar, from 60 bar to 125 bar, from 60 bar to 115 bar, from 70 bar to 115 bar, or any subset thereof.

In various embodiments, the hydrogenation unit 120 may be operated at a liquid hourly space velocity (LHSV) of from 0.5 $h^{-1}$ to 5 $h^{-1}$, such as 1 $h^{-1}$ to 5 $h^{-1}$, 2 $h^{-1}$ to 3 $h^{-1}$, 0.5 $h^{-1}$ to 4 $h^{-1}$, 0.5 $h^{-1}$ to 3 $h^{-1}$, 0.5 $h^{-1}$ to 2 $h^{-1}$, or any subset thereof.

The hydrogenation unit 120 may be an existing unit operation or reactor already available within an existing refinery. For example, the hydrogenation unit 120 can constitute a batch reactor, a semi-batch reactor, a flow fluidized reactor, a flow fixed reactor or their combinations. Examples of hydrogenation units 120 which may be utilized within existing refinery architecture include hydrotreaters, hydrocrackers, hydrodesulfurization units, ammonia production units such as Haber-Bosch process reactors, and methanol production units from syngas and/or $CO_2$. The hydrogenation unit 120 units are those typically processing natural gas, naphtha, full range naphtha, light naphtha, heavy naphtha, kerosene, jet-fuel, distillate, diesel, fuel oil, vacuum gas oil (VGO), gasoline, atmospheric resid and vacuum resid, $CO_2$, nitrogen, or their mixtures.

Still referring to FIG. 1, hydrogenation unit 120 may produce hydrotreated effluent stream 122. The hydrotreated effluent stream 122 comprises saturated liquid organic hydrogen carriers, unreacted hydrogen, and byproducts. Specifically, LOHCs in their unsaturated state comprise organic molecules with C—C double or triple bonds and the hydrogenation unit 120 saturates such LOHCs resulting in the addition of hydrogen atoms and cleavage of the C—C double and triple bonds. Whether a LOHC is in a saturated state or an unsaturated state may be determined by one skilled in the art based on context throughout the present disclosure.

The hydrotreated effluent stream 122 comprises the hydrotreated plastic oil stream 102. The hydrotreated effluent stream 122 may have a greater ratio of hydrogen to carbon than the plastic oil stream 102 as a result of the hydrogenation of the plastic oil stream 102 to generate the saturated liquid organic hydrogen carriers. For example, the degree of saturation of the hydrocarbons in the hydrotreated effluent stream 122 may be higher than the degree of saturation in the plastic oil stream 102.

In one or more embodiments, processing of the plastic oil stream 102 in the hydrogenation unit 120 reduces or eliminates the presence of sulfur and nitrogen containing compounds. The hydrotreated effluent stream 122 may comprise less than 1 wt %, such as less than 0.5 wt %, less than 0.1 wt %, less than 0.01 wt %, or even less than 0.001 wt % of the combined weight of sulfur and nitrogen.

As described herein, in some embodiments the hydrotreated effluent stream 122 may be passed to a separator 130. Separator 130 may separate the hydrotreated effluent stream 122 to isolate the liquid organic hydrogen carriers as an LOHC stream 132 from the unreacted hydrogen and byproducts. The unreacted hydrogen and byproducts are effused from the separator 130 as a residual stream 134. The separator 130 may be any separation unit capable of separating the liquid organic hydrogen carriers from the remainder of the hydrotreated effluent stream 122.

In one or more embodiments, the separator 130 may be an extractive separation unit. In an extractive separation unit, a liquid-liquid extraction is performed to remove one or more compounds (such as aromatic compounds) from the bulk feedstock into a solvent. The solvent may be a polar compound, such as methanol or ethanol, to selectively capture LOHCs due to their affinity for polar functional groups in LOHC molecules. The solvent may then be separated in any suitable separation unit, such as, and without limitation, a series of flash vessels or a fractionator/distillation column that separates feedstock based on the boiling point, to remove the separated compounds. The separator 130 may include any suitable separation unit, such as, and without limitation, a series of flash vessels or a fractionator/distillation column that separates feedstock based on the boiling point or separation based on molecule size with molecular sieves.

The residual stream 134 including the unreacted hydrogen and byproducts is provided to a reclamation unit 140 to recover the unreacted hydrogen as a recovered hydrogen stream 142 from the residual stream 134. The remainder of the residual stream 134 upon removal of the unreacted hydrogen is a byproducts stream 144. The byproducts stream 144 includes the hydrocarbons which were not converted into LOHCs and this removed as part of the residual stream 134 in the separator 130. Examples of unconverted hydrocarbons in the byproducts stream 144 include polyaromatic hydrocarbons, olefins, sulfur compounds, nitrogen compounds, and heavy hydrocarbons. In one or more embodiments, the byproducts stream 144 may be further processed to recover further value added streams.

The recovered hydrogen stream 142 may be recycled back to the hydrogenation unit 120 to offset hydrogen demand from the input hydrogen stream 104. In one or more embodiments, the recovered hydrogen stream 142 may be compressed or undergo further purification before providing to the hydrogenation unit 120.

In one or more embodiments and with reference to FIG. 2, the plastic oil stream 102 may be provided to a pre-treatment unit 150 to generate a pretreated plastic oil stream 106. The pretreated plastic oil stream 106 may then be passed to the hydrogenation unit 120 in lieu of the plastic oil stream 102. The pre-treatment unit 150 removes one or more impurities from the plastic oil stream 102 in an impurities stream 152 as plastic oils typically include impurities which may hinder efficient hydrogenation and conversion to LOHCs or have an undesirable effect on downstream processing equipment. Contaminants or impurities in the plastic oil stream 102 which are removed in the impurities stream 152 may include solids, water, and non-plastic materials. It will be appreciated that if multiple units or processes are utilized as part of the pre-treatment unit 150 the impurities stream 152 may be formed from multiple individual streams for distinct units or may include multiple individual impurities streams 152 with a single instance originating from each of the multiple units or processes. Examples of solids which may be present in the plastic oil stream 102 include particles of unprocessed plastics, contaminants such a metals, and residue from pyrolysis or other treatment processes.

In one or more embodiments, the pre-treatment unit 150 comprises a filtration unit, a settling unit, or a centrifugation unit to remove solid impurities from the plastic oil stream 102. The filtration unit passes the plastic oil stream 102 through a permeable porous filtration medium to retain unwanted particles such as solid impurities that are in suspension in the plastic oil stream 102. The filtration medium may be sized to remove solid particles with a size greater than 100 μm, greater than 50 μm, greater than 25 μm, greater than 10 μm, greater than 5 μm, or greater than 1 μm in accordance with various embodiments. The settling unit removes solid particles from the plastic oil stream 102 by gravitational forces acting on the solid particles. Specifically, the solid particles are allowed to settle out of the plastic oil as it flows slowly through a settling tank before passage to the hydrogenation unit 120. Finally, centrifugation may be utilized to separate the solid particles from the remainder of the plastic oil stream 102 based on the difference in relative density between the plastic oil and any suspected solid particles.

In one or more embodiments, the pre-treatment unit 150 removes sulfur (S), nitrogen (N), oxygen (O), chlorine (Cl), or combinations of the same from the plastic oil stream 102. Various species, such as chlorine, may be present in the plastic oil stream 102 which may have a detrimental effect on downstream processes. Specifically, in one or more embodiments, sulfur may be removed with hydrotreatment by treating the plastic oil stream 102 with hydrogen in the presence of a catalyst to remove sulfur by converting sulfur-containing compounds into hydrogen sulfide ($H_2S$). Removal of sulfur is desirable as high sulfur levels can lead to corrosion of equipment and catalyst poisoning in downstream processes. Further, in one or more embodiments, nitrogen may be removed with hydrotreatment by treating the plastic oil stream 102 with hydrogen in the presence of a catalyst to remove nitrogen by converting nitrogen-containing compounds into ammonia ($NH_3$) or other nitrogen gases. Removal of nitrogen is desirable as elevated nitrogen levels can affect the performance of catalysts and cause issues in the refining process. In one or more embodiments, oxygen may be removed with hydrotreatment by treating the plastic oil stream 102 with hydrogen in the presence of a catalyst to remove or reduce oxygen through reaction of oxygen and hydrogen to generate water. Removal of oxygen is desirable oxygen can lead to oxidation, reducing the stability of the plastic oil and causing issues in downstream processes. Finally, in one or more embodiments, hydrotreating can also aid in removing chlorine from the plastic oil stream 102 by converting chlorine-containing compounds into hydrogen chloride (HCl). Removal of chlorine is desirable as chlorine is corrosive and can lead to damage to equipment, particularly in refining processes. Chlorine can also negatively impact catalysts.

In one or more embodiments, a second hydrocarbon stream 108 may be provided to the hydrogenation unit 120 in combination with the plastic oil stream 102 or the pretreated plastic oil stream 106. Referring to FIG. 2, a schematic illustration of one or more generalized embodiments of the present disclosure is presented with illustration of a second hydrocarbon stream 108 being combined with the pretreated plastic oil stream 106 prior to introduction to the hydrogenation unit 120. It is noted that reference will be made to the plastic oil stream 102 throughout the present disclosure but such reference naturally includes reference to the pretreated plastic oil stream 106 in one or more embodiments including the pre-treatment unit 150.

The composition of the hydrocarbon streams as fed to the hydrogenation unit 120 may vary from 0.1 wt % to 100 wt. % of the plastic oil, whether the plastic oil stream 102 or the pretreated plastic oil stream 106, with the remainder comprising the second hydrocarbon stream 108. In various embodiments, the hydrocarbon feed to the hydrogenation unit 120 may comprise 0.1 to 100 wt. % of plastic oil, 20 to 100 wt. % of plastic oil, 40 to 100 wt. % of plastic oil, 60 to 100 wt. % of plastic oil, 80 to 100 wt. % of plastic oil, or substantially 100 wt. % plastic oil. In one or more embodiments, the second hydrocarbon stream 108 may be a heavy naphtha stream or an aromatics-rich stream.

The heavy naphtha stream when provided as the second hydrocarbon stream 108 may refer to a hydrocarbon cut, such as a cut of a crude oil. The heavy naphtha stream may have an initial boiling point (IBP) of from 80 °C to 100 °C, such as from 80 °C to 95 °C, from 85° C. to 100 °C, from 88 °C to 100 °C, from 80 °C to 92 °C, or from 88 °C to 92 °C. The heavy naphtha stream may have a final boiling point (FBP) of from 180 °C to 220 °C, such as from 180 °C to 215 °C, from 180 °C to 210 °C, from 180 °C to 205 °C, from 185 °C to 220 °C, from 190 °C to 220 °C, from 195 °C to 220 °C, from 185 °C to 215 °C, from 190 °C to 210° C., from 195 °C to 205 °C, or any subset thereof. The heavy naphtha stream may comprise or consist of hydrocarbons.

The aromatics-rich stream when provided as the second hydrocarbon stream 108 may comprise a stream comprising at least 50 wt % aromatic compounds %, such as at least 60 wt %, at least 70 wt %, at least 80 wt %, at least 90 wt %, at least 95 wt %, at least 99 wt %, or even at least 99.9 wt % of aromatic compounds, on the basis of the total weight of the aromatics-rich stream. In one or more embodiments, the aromatic-rich stream may comprise at least 50 wt % C9+ aromatic compounds (aromatic compounds having at least 9 carbon atoms). Suitable C9+ aromatic compounds may include, without limitation, benzyl toluene, dibenzyl toluene, methylindole, phenazine, and ethylcarbazole. Further, in one or more embodiments, suitable C9+ aromatic compounds include any bi-cyclic or poly cyclic aromatic hydrocarbon. In various embodiments, the aromatics-rich stream may comprise at least 50 wt %, such as at least 60 wt %, at least 70 wt %, at least 80 wt %, at least 90 wt %, at least 95 wt %, at least 99 wt %, or even at least 99.9 wt % of the C9+ aromatic compounds, on the basis of the total weight of the aromatics-rich stream.

Now referring to FIG. 3, where the system 10 for producing liquid organic hydrogen carriers from plastic oil may include at least a first hydrocarbon processing facility 100 and a second hydrocarbon processing facility 200, where the first hydrocarbon processing facility 100 and a second hydrocarbon processing facility 200 are in different geographic locations, as described herein. In general, a single hydrocarbon processing facility, such as the first hydrocarbon processing facility 100 and a second hydrocarbon processing facility 200, is a processing facility that is only locally integrated with other processing facilities, and generally refers to an integrated complex capable of transforming its respective hydrocarbon feedstock into its respective products. For example, a single hydrocarbon processing facility may be under the control of a single body, such as a single control room or manager. In one or more embodiments, each of the first hydrocarbon processing facility 100 and the second hydrocarbon processing facility 200 may independently be oil refineries. For example, the first hydrocarbon processing facility 100 and a second hydrocarbon processing facility 200 may be oil refineries, respectively, that are in different geographic regions. Geographic regions may refer to portions of the Earth's surface that are divided by physical characteristics, such as hemispheres of the earth, continents or portions thereof, climates, altitudes, proximity to mountains or bodies of water; or socio-political characteristics, such as predominant languages, nation-states, provinces, or cities. The first hydrocarbon processing facility 100 and the second hydrocarbon processing facility 200 may be separate from one another with distance or other barrier making transfer of products between first hydrocarbon processing facility 100 and the second hydrocarbon processing facility 200 challenging or impractical under typical circumstances. For example, the first hydrocarbon processing facility 100 and the second hydrocarbon processing facility 200 may be at least 1 km apart from one another, such as at least 100 km, at least 200 km, at least 500 km, or at least 1000 km. In one or more embodiments, the first hydrocarbon processing facility 100 and the second hydrocarbon processing facility 200 may reside at different latitudes or different time zones.

It will be appreciated that the distance or other barrier between the first hydrocarbon processing facility 100 and the second hydrocarbon processing facility 200 which is considered challenging or impractical under typical circumstances may depend on the specific species requiring transport. For example, the physical distance between the first hydrocarbon processing facility 100 and the second hydrocarbon processing facility 200 may make conventional transportation of hydrogen between the first hydrocarbon processing facility 100 and the second hydrocarbon processing facility 200 difficult. Use of the present methods and systems may allow cheaper and more efficient transport of hydrogen between the first hydrocarbon processing facility 100 and the second hydrocarbon processing facility 200, thereby allowing an operator to take advantage of cheaper and/or renewable sources of electricity available near the first hydrocarbon processing facility 100. In some embodiments, the first hydrocarbon processing facility 100 and the second hydrocarbon processing facility 200 may be located at different latitudes, which may allow the operator to take advantage of variations in energy production, such as the increased production of electricity of a given solar panel when placed closer to the equator.

As is shown in FIG. 3, the first hydrocarbon processing facility 100 may comprise the at least one hydrogenation unit 120, the separator 130, the reclamation unit 140, and the one or more pre-treatment units 150, as present. Further, the second hydrocarbon processing facility 200 may comprise the dehydrogenation unit 210.

In one or more embodiments and with reference to FIG. 3, the LOHC stream 132, or a portion thereof, may be transported from the first hydrocarbon processing facility 100 to the second hydrocarbon processing facility 200. Transporting may refer to the process of physically moving hydrocarbons, and to the process of preparing the hydrocarbons to be physically moved, from the first hydrocarbon processing facility 100 to the second hydrocarbon processing facility 200, and to the storage of hydrocarbons before, during, or after physical movement of the hydrocarbons. Where hydrogen is transported, the hydrogen may be transported in the form of hydrogen atoms covalently bonded to hydrocarbon molecules. In one or more embodiments, transporting the LOHC stream 132, or a portion thereof, may comprise transporting the LOHC stream 132, or a portion thereof, from the first hydrocarbon processing facility 100 to the second hydrocarbon processing facility 200 by tanker truck, train, ship, and/or pipeline. In one or more embodiments, the hydrocarbons may be transported from the first hydrocarbon processing facility 100 to the second hydrocarbon processing facility 200 by tanker truck, train, and/or ship. A time of at least 2 weeks, such as at least 1 month, at least 2 months, or at least 6 months, may pass between hydrotreating the plastic oil stream 102 and dehydrogenating the LOHC stream 132. The transportation step may include storing the hydrocarbons at the first hydrocarbon processing facility 100, the second hydrocarbon processing facility 200, at an intermediate storage or processing facility, or in the transportation vessel itself. The temporal difference between the hydrotreating and dehydrogenating steps may allow the operator to store intermittent electricity in the form of hydrogen for use during times of higher demand, such as storing summer solar power for winter.

Still referring to FIG. 3, the LOHC stream 132, or a portion thereof, may be passed to a dehydrogenation unit 210 to form hydrogen product stream 212 and dehydrogenated LOHC stream 214. The dehydrogenation unit 210 may be any refinery process unit capable of removing hydrogen atoms from a hydrocarbon molecule to form hydrogen gas. Suitable refinery process units for use as dehydrogenation unit 210 include, for example, steam crackers, catalytic reformers, aromatization units, and the like. For example, the dehydrogenation unit 210 may be any single independent dehydrogenation unit such as a propane to propene unit. Where the dehydrogenation unit 210 is a catalytic reformer which contacts the hydrocarbons with a catalyst, the catalyst may comprise iron (such as iron (III) oxide), potassium oxide, potassium chloride, noble metal (Pt or Re) supported on a silica or silica-alumina base, or a combination thereof. The catalytic reformer may operate at a reaction temperature of from 50 °C to 700 °C, such as from 100 °C to 700 °C, from 200 °C to 700 °C, from 300 °C to 700 °C, from 400 °C to 700 °C, from 50 °C to 600 °C, from 200 °C to 600 °C, from 300 °C to 600 °C, from 400 °C to 600 °C, or any subset thereof; a reaction pressure of from 1 bar to 50 bar, such as from 1 bar to 30 bar, from 1 bar to 20 bar, from 1 bar to 10 bar, from 5 bar to 50 bar, from 10 bar to 50 bar, from 20 bar to 50 bar, from 30 bar to 50 bar, or any subset thereof; and a liquid hourly space velocity (LHSV) of from 0.5 $h^{-1}$ to 5 $h^{-1}$, such as from 0.5 $h^{-1}$ to 4 $h^{-1}$, from 0.5 $h^{-1}$ to 3 $h^{-1}$, from 0.5 $h^{-1}$ to 2 $h^{-1}$, from 0.5 $h^{-1}$ to 1 $h^{-1}$, from 1 $h^{-1}$ to 5 $h^{-1}$, from 2 $h^{-1}$ to 5 $h^{-1}$, from 3 $h^{-1}$ to 5 $h^{-1}$, from 4 $h^{-1}$ to 5 $h^{-1}$, or any subset thereof.

In one or more embodiments, the dehydrogenated LOHC stream 214 may comprise hydrocarbons and have a lower hydrogen to carbon ratio than the LOHC stream 132. For example, the dehydrogenated LOHC stream 214 may have a lower degree of saturation than the LOHC stream 132.

In one or more embodiments, hydrogen product stream 212 may comprise hydrogen gas, such as at least 80 wt. %, at least 90 wt. %, at least 99 wt. %, at least 99.9 wt. %, at least 99.99 wt. %, or 99.999 wt. % of hydrogen gas, on the basis of the total weight of the hydrogen product stream 212. The hydrogen product stream 212 may comprise less than 500 parts per million by weight (ppm), less than 250 ppm, less than 100 ppm, less than 50 ppm, less than 20 ppm, or less than 10 ppm, less than 5 ppm, less than 2.5 ppm, or less than 1 ppm of each of sulfur and carbon monoxide. One practical and growing application for hydrogen gas is for use in fuel cells. Generally, low temperature fuel cells use precious metal catalysts which are susceptible to poisoning by sulfur and CO in their hydrogen fuels. Thus, it may be desirable for the hydrogen product stream 212 to contain relatively low amounts of sulfur and CO.

Figure 4:
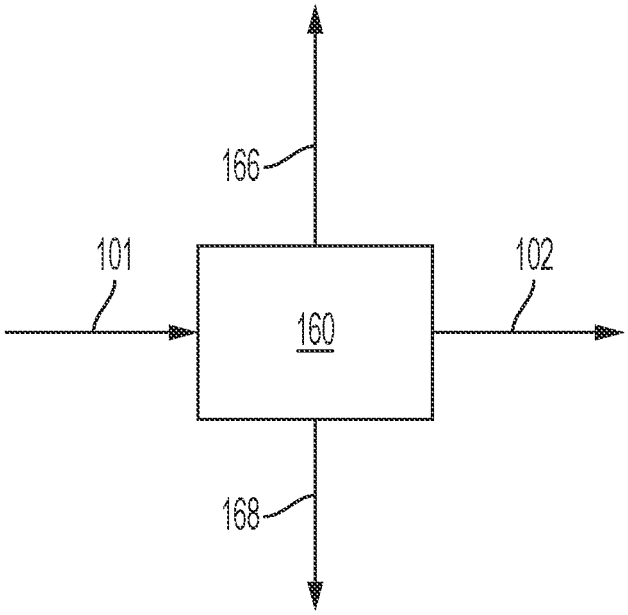
FIG. 4 schematically depicts a diagram of a system for producing plastic oil through pyrolysis, according to one or more embodiments described in this disclosure For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not necessarily depicted. However, operational components, such as those described in the present disclosure, may be added to the embodiments described in this disclosure.

In one or more embodiments and with reference to FIG. 4, the plastic oil stream 102 is generated from pyrolysis of waste plastics. Accordingly, the system 10 may include a plastic pyrolysis unit 160 which converts a plastics stream 101 to gaseous products, liquid products, and solid material. The liquid products are provided as an effluent from the plastic pyrolysis unit 160 as the plastic oil stream 102. The stream of gaseous products are generically shown in FIG. 4 as off-gas stream 166. The gaseous products in the off-gas stream 166 may include various species such as hydrogen and hydrocarbon gases (C1-C4), carbon monoxide (CO), carbon dioxide ($CO_2$), and other acid gases. The generated solid material is generically shown in FIG. 4 as solids stream 168.

The specific reactor used as the plastic pyrolysis unit 160 can be of different types and are not limited for the purposes of the present disclosure. One skilled in the art will appreciate that typical reactor types that can be used to serve the function of the plastic pyrolysis unit 160 are tank reactors, rotary kilns, packed beds, bubbling and circulating fluidized bed and others. In one or more embodiments, the pyrolysis of the plastics stream 101 is performed in the presence or absence of a pyrolysis catalyst at a temperature of 300 to 1000 °C. In various further embodiments, the plastic pyrolysis unit 160 may operate at a low severity at a temperature less than or equal to 450 °C, at a high severity at a temperature at a temperature greater than 450 °C, at a temperature of 300 to 450 °C, at a temperature of 450 to 1000 °C, at a temperature of 450 to 750 °C, at a temperature of 600 to 1000 °C, or at a temperature of 750 to 1000 °C. In various embodiments, the plastic pyrolysis unit 160 may operate at a pressure in the range of 1 to 100 bars, 1 to 50 bars, 1 to 25 bars, or 1 to 10 bars. Further, in various embodiments, the residence time of the plastic feedstock in the plastic pyrolysis unit 160 may be 1 to 3600 seconds, 60 to 1800 seconds, or 60 to 900 seconds.

In one or more embodiments, the plastics stream 101 comprises a plastic feedstock including mixed plastics of differing compositions. The plastic feedstock provided to the plastic pyrolysis unit 160 to generate the plastic oil stream 102 may be a mixture of plastics from various polymer families. In various embodiments, the plastic feedstock may comprise plastics representative of one or more of the polymer families disclosed in Table 2. Specifically, the plastic feedstock may comprise plastics representative of one or more of olefins, carbonates, aromatic polymers, sulfones, fluorinated hydrocarbon polymers, chlorinated hydrocarbon polymers, and acrylonitriles. Further, the plastic feedstock provided to the plastic pyrolysis unit 160 may be a mixture of high density polyethylene (HDPE, for example, a density of about 0.93 to 0.97 grams per cubic centimeter ($g/cm^3$), low density polyethylene (LDPE, for example, about 0.910 $g/cm^3$ to 0.940 $g/cm^3$), polypropylene (PP), linear low density polyethylene (LLDPE), polystyrene (PS), polyethylene terephthalate (PET). It will be appreciated that utilization of the mixed plastics feedstock allows for recycling of plastics without necessitating fine sorting of the plastics.

TABLE 2

| Example Polymers | | | |
|---|---|---|---|
| Polymer family | Example polymer | Melting Point, ° C. | Structure |
| Olefins | Polyethylene (PE) | 115-135 | 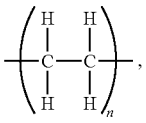 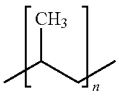 |

TABLE 2-continued

| Example Polymers | | | |
|---|---|---|---|
| Polymer family | Example polymer | Melting Point, ° C. | Structure |
| Olefins | Polypropylene (PP) | 115-135 | 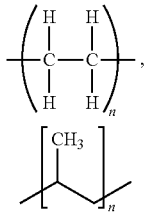 |
| carbonates | diphenylcarbonate | 83 | 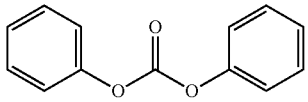 |
| aromatics | Polystyrene (PS) | 240 | 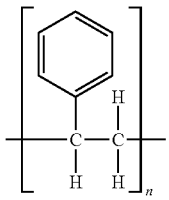 |
| Sulfones | Polyether sulfone | 227-238 | 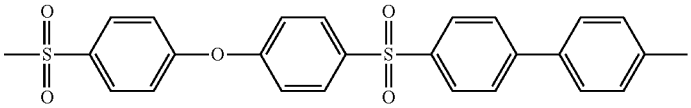 |
| Fluorinated hydrocarbons | Polytetrafluoroethylene (PTFE) | 327 | 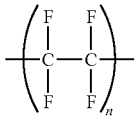 |
| Chlorinated hydrocarbons | Polyvinyl chloride (PVC) | 100-260 | 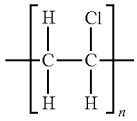 |
| Acyrilnitriles | Polyacrylonitrile (PAN) | 300 | 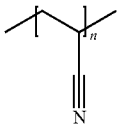 |

The plastics forming the plastics stream 101 may be provided in a variety of different forms. The plastics may be in the form of a powder in smaller scale operations. The plastics may be in the form of pellets, such as those with a particle size of from 1 to 5 millimeter (mm) for larger scale operations. In further embodiments, the plastics may be provided as a chopped or ground product. Further, the plastics forming the plastics stream 101 may be natural synthetic or semi-synthetic polymers. In various embodiments, the plastics stream 101 may comprise waste plastic, manufacturing off-spec product, new plastic products, unused plastic products, as well as their combinations.

It should now be understood the various aspects of the method and associated system for producing liquid organic hydrogen carriers from plastic oil are described and such aspects may be utilized in conjunction with various other aspects.

According to a first aspect, a method for producing liquid organic hydrogen carriers from plastic oil comprises passing a plastic oil stream and an input hydrogen stream to a hydrogenation unit to form a hydrotreated effluent stream, wherein the plastic oil stream comprises the liquid fraction from pyrolysis of waste plastics and the hydrotreated effluent stream comprises saturated liquid organic hydrogen carriers, unreacted hydrogen, and byproducts; passing the hydrotreated effluent stream to a separator to isolate the liquid organic hydrogen carriers as an LOHC stream from the unreacted hydrogen and byproducts as a residual stream; passing the residual stream to a reclamation unit to recover the unreacted hydrogen as a recovered hydrogen stream from the residual stream to generate a byproducts stream, wherein the byproducts stream comprise a remainder of the residual stream upon recapture of the unreacted hydrogen;

and passing the recovered hydrogen stream to the hydrogenation unit to offset hydrogen demand from the input hydrogen stream.

A second aspect includes the method of the first aspect in which the method further comprises passing the plastic oil stream to a pre-treatment unit to generate a pretreated plastic oil stream and passing the pretreated plastic oil stream to the hydrogenation unit in lieu of the plastic oil stream, wherein the pre-treatment unit removes one or more impurities from the plastic oil stream.

A third aspect includes the method of the second aspect in which the pre-treatment unit comprises a filtration unit, a settling unit, or a centrifugation unit to remove solid impurities from the plastic oil stream.

A fourth aspect includes the method of the second or third aspect in which the pre-treatment unit removes sulfur (S), nitrogen (N), oxygen (O), chlorine (Cl), or combinations of the same from the plastic oil stream.

A fifth aspect includes the method of any of the first through fourth aspects in which the method further comprises passing a second hydrocarbon stream to the hydrogenation unit in combination with the plastic oil stream.

A sixth aspect includes the method of the fifth aspect in which the second hydrocarbon stream comprises a heavy naphtha stream.

A seventh aspect includes the method of the fifth or sixth aspect in which the second hydrocarbon stream comprises an aromatics-rich stream.

An eighth aspect includes the method of the seventh aspect in which the aromatics-rich stream comprises at least 50% by weight aromatic compounds having at least 9 carbon atoms.

A ninth aspect includes the method of any of the first through eighth aspects in which the method further comprises transporting the LOHC stream from a first hydrocarbon processing facility to a second hydrocarbon processing facility; and passing the LOHC stream to a dehydrogenation unit to form a dehydrogenated hydrocarbon stream and a hydrogen product stream, wherein the first hydrocarbon processing facility and the second hydrocarbon processing facility are separated by at least 1 km.

A tenth aspect includes the method of the ninth aspect in which the dehydrogenation unit is a catalytic reformer.

An eleventh aspect includes the method of the ninth or tenth aspect in which the second hydrocarbon processing facility is an oil refinery.

A twelfth aspect includes the method of any of the ninth through eleventh aspects in which transporting the LOHC stream comprises moving the LOHC stream by truck, train, ship, and/or pipeline.

A thirteenth aspect includes the method of any of the first through twelfth aspects in which the hydrogenation unit is operated at reaction conditions of from 300 °C to 420 °C; a pressure of from 15 to 150 bar; and a liquid hourly space velocity (LHSV) of from 0.5 $h^{-1}$ to 5 $h^{-1}$.

A fourteenth aspect includes the method of any of the first through thirteenth aspects in which the hydrogenation unit comprises a hydrotreating catalyst, the hydrotreating catalyst comprising cobalt, molybdenum, or tungsten on an alumina support.

A fifteenth aspect includes the method of any of the first through fourteenth aspects in which the separator comprises a distillation unit to generate the LOHC stream and the residual stream based on relative vapor pressures.

A sixteenth aspect includes the method of any of the first through fifteenth aspects in which the separator is an extractive separation unit.

A seventeenth aspect includes the method of any of the first through sixteenth aspects in which the byproducts stream is further processed to recover further value added streams.

An eighteenth aspect includes the method of any of the first through seventeenth aspects in which the method further comprises conducting pyrolysis of a plastic feedstock comprising mixed waste plastics to produce the plastic oil stream.

A nineteenth aspect includes the method of the eighteenth aspect in which the pyrolysis of a plastic feedstock is performed in the presence of a catalyst at a temperature of 300 °C to 1000 °C According to a twentieth aspect, a method for producing liquid organic hydrogen carriers from plastic oil includes passing a plastic oil stream to a pre-treatment unit to generate a pretreated plastic oil stream; passing the pretreated plastic oil stream and an input hydrogen stream to a hydrogenation unit to form a hydrotreated effluent stream, wherein the plastic oil stream comprises the liquid fraction from pyrolysis of waste plastics and the hydrotreated effluent stream comprises saturated liquid organic hydrogen carriers, unreacted hydrogen, and byproducts; passing the hydrotreated effluent stream to a separator to isolate the liquid organic hydrogen carriers as an LOHC stream from the unreacted hydrogen and byproducts as a residual stream; passing the residual stream to a reclamation unit to recover the unreacted hydrogen as a recovered hydrogen stream from the residual stream to generate a byproducts stream, wherein the byproducts stream comprise a remainder of the residual stream upon recapture of the unreacted hydrogen; passing the recovered hydrogen stream to the hydrogenation unit to offset hydrogen demand from the input hydrogen stream; transporting the LOHC stream from a first hydrocarbon processing facility to a second hydrocarbon processing facility; and passing the LOHC stream to a dehydrogenation unit to form a dehydrogenated hydrocarbon stream and a hydrogen product stream, wherein the first hydrocarbon processing facility houses at least the hydrogenation unit, the separator, and the reclamation unit, the second hydrocarbon processing facility houses at least the dehydrogenation unit and the first hydrocarbon processing facility and the second hydrocarbon processing facility are separated by at least 100 km.

For the purposes of describing and defining the present disclosure it is noted that the terms "about" or "approximately" are utilized in this disclosure to represent the inherent degree of uncertainty that may be attributed to any quantitative comparison, value, measurement, or other representation. The terms "about" and/or "approximately" are also utilized in this disclosure to represent the degree by which a quantitative representation may vary from a stated reference without resulting in a change in the basic function of the subject matter at issue.

Throughout this disclosure ranges are provided. It is envisioned that each discrete value encompassed by the ranges are also included. Additionally, the ranges which may be formed by each discrete value encompassed by the explicitly disclosed ranges are equally envisioned. For brevity, the same is not explicitly indicated subsequent to each disclosed range and the present general indication is provided.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It is also noted that recitations herein of "at least one" component, element, etc., should not be used to create an inference that the alternative use of the articles "a" or "an" should be limited to a single component, element, etc.

What is claimed is:

1. A method for producing liquid organic hydrogen carriers from plastic oil, the method comprising:

passing a plastic oil stream and an input hydrogen stream in combination with a second hydrocarbon stream to a hydrogenation unit to form a hydrotreated effluent stream, wherein:

the plastic oil stream comprises a liquid fraction from pyrolysis of waste plastics;

the second hydrocarbon stream comprises an aromatics-rich stream comprising at least 50% by weight aromatic compounds having at least 9 carbon atoms; and the hydrotreated effluent stream comprises saturated liquid organic hydrogen carriers, unreacted hydrogen, and byproducts;

passing the hydrotreated effluent stream to a separator to isolate the liquid organic hydrogen carriers as an LOHC stream from the unreacted hydrogen and byproducts as a residual stream;

passing the residual stream to a reclamation unit to recover the unreacted hydrogen as a recovered hydrogen stream from the residual stream to generate a byproducts stream, wherein the byproducts stream comprises a remainder of the residual stream upon recapture of the unreacted hydrogen; and passing the recovered hydrogen stream to the hydrogenation unit to offset hydrogen demand from the input hydrogen stream.

2. The method of claim 1, further comprising passing the plastic oil stream to a pre-treatment unit to generate a pretreated plastic oil stream and passing the pretreated plastic oil stream to the hydrogenation unit in lieu of the plastic oil stream, wherein the pre-treatment unit removes one or more impurities from the plastic oil stream.

3. The method of claim 2, wherein the pre-treatment unit comprises a filtration unit, a settling unit, or a centrifugation unit to remove solid impurities from the plastic oil stream.

4. The method of claim 2, wherein the pre-treatment unit removes sulfur(S), nitrogen (N), oxygen (O), chlorine (Cl), or combinations of the same from the plastic oil stream.

5. The method of claim 1, further comprising transporting the LOHC stream from a first hydrocarbon processing facility to a second hydrocarbon processing facility; and passing the LOHC stream to a dehydrogenation unit to form a dehydrogenated hydrocarbon stream and a hydrogen product stream, wherein the first hydrocarbon processing facility and the second hydrocarbon processing facility are separated by at least 1 km.

6. The method of claim 5, wherein the dehydrogenation unit is a catalytic reformer.

7. The method of claim 5, wherein the second hydrocarbon processing facility is an oil refinery.

8. The method of claim 5, wherein transporting the LOHC stream comprises moving the LOHC stream by truck, train, ship, and/or pipeline.

9. The method of claim 1, wherein the hydrogenation unit is operated at reaction conditions of from 300 °C to 420 °C; a pressure of from 15 to 150 bar; and a liquid hourly space velocity (LHSV) of from 0.5 h-1 to 5 h-1.

10. The method of claim 1, wherein the hydrogenation unit comprises a hydrotreating catalyst, the hydrotreating catalyst comprising cobalt, molybdenum, or tungsten on an alumina support.

11. The method of claim 1, wherein the separator comprises a distillation unit to generate the LOHC stream and the residual stream based on relative vapor pressures.

12. The method of claim 1, wherein the separator is an extractive separation unit.

13. The method of claim 1, wherein the byproducts stream is further processed to recover further value added streams.

14. The method of claim 1, further comprising conducting pyrolysis of a plastic feedstock comprising mixed waste plastics to produce the plastic oil stream.

15. The method of claim 14, wherein the pyrolysis of a plastic feedstock is performed in the presence of a catalyst at a temperature of 300 °C to 1000 °C.

16. A method for producing liquid organic hydrogen carriers from plastic oil, the method comprising:

passing a plastic oil stream to a pre-treatment unit to generate a pretreated plastic oil stream;

passing the pretreated plastic oil stream and an input hydrogen stream in combination with a second hydrocarbon stream to a hydrogenation unit to form a hydrotreated effluent stream, wherein:

the plastic oil stream comprises a liquid fraction from pyrolysis of waste plastics;

the second hydrocarbon stream comprises an aromatics-rich stream comprising at least 50% by weight aromatic compounds having at least 9 carbon atoms; and the hydrotreated effluent stream comprises saturated liquid organic hydrogen carriers, unreacted hydrogen, and byproducts;

passing the hydrotreated effluent stream to a separator to isolate the liquid organic hydrogen carriers as an LOHC stream from the unreacted hydrogen and byproducts as a residual stream;

passing the residual stream to a reclamation unit to recover the unreacted hydrogen as a recovered hydrogen stream from the residual stream to generate a byproducts stream, wherein the byproducts stream comprises a remainder of the residual stream upon recapture of the unreacted hydrogen;

passing the recovered hydrogen stream to the hydrogenation unit to offset hydrogen demand from the input hydrogen stream;

transporting the LOHC stream from a first hydrocarbon processing facility to a second hydrocarbon processing facility; and passing the LOHC stream to a dehydrogenation unit to form a dehydrogenated hydrocarbon stream and a hydrogen product stream, wherein:

the first hydrocarbon processing facility houses at least the hydrogenation unit, the separator, and the reclamation unit;

the second hydrocarbon processing facility houses at least the dehydrogenation unit; and the first hydrocarbon processing facility and the second hydrocarbon processing facility are separated by at least 100 km.

* * * * *